US005817605A

United States Patent [19]

Papay

[11] Patent Number: 5,817,605

[45] Date of Patent: Oct. 6, 1998

[54] AUTOMATIC TRANSMISSION AND WET BRAKE FLUIDS AND ADDITIVE PACKAGE THEREFOR

[75] Inventor: Andrew G. Papay, Manchester, Mo.

[73] Assignee: Ethyl Petroleum Additives, Inc., Richmond, Va.

[21] Appl. No.: 709,369

[22] Filed: Jun. 3, 1991

[51] Int. Cl.[6] ..... C10M 105/14

[52] U.S. Cl. ..... 508/187; 508/185; 508/188; 508/189; 508/192; 508/194; 508/227; 508/228; 508/346; 508/355; 508/583; 508/421; 508/419; 508/420

[58] Field of Search ..... 252/52 R, 49.9, 252/51.5 R; 508/185, 187, 188, 189, 192, 194, 227, 228, 346, 355, 583, 421, 419, 420

[56] References Cited

U.S. PATENT DOCUMENTS

| | | | |
|---|---|---|---|
| 2,136,846 | 11/1938 | Furlotti | 508/487 |
| 2,932,615 | 4/1960 | Jordan et al. | 508/302 |
| 3,238,130 | 3/1966 | Matson | 508/250 |
| 3,304,258 | 2/1967 | White | 508/449 |
| 3,389,088 | 6/1968 | Schar et al. | 252/73 |
| 4,331,222 | 5/1982 | Liston et al. | 188/264 B |
| 4,857,214 | 8/1989 | Papay et al. | 508/188 |

FOREIGN PATENT DOCUMENTS

| | | |
|---|---|---|
| 0286996 | 10/1988 | European Pat. Off. . |
| 0348236 | 12/1989 | European Pat. Off. . |
| 0353854 | 2/1990 | European Pat. Off. . |
| 353854 | 2/1990 | European Pat. Off. . |

*Primary Examiner*—Alan Diamond
*Attorney, Agent, or Firm*—Dennis H. Rainear; Thomas Hamilton

[57] ABSTRACT

Oil-based functional fluid compositions formulated for use as automatic transmission fluid, fluid for a wet brake system, or a friction-depending lubricant are improved by including in the composition a minor amount of at least one alcohol or polyol having less than 12 carbon atoms in the molecule. This results in a desirable increase in the dynamic and/or static coefficients of friction of automatic transmission or other frictional surfaces contacted by the composition. Preferred for this use is a composition formed by heating at least one ashless dispersant containing basic nitrogen and/or at least one hydroxyl group with a combination of at least (i) an inorganic acid of phosphorus, (ii) a boron compound, and (iii) a polyol having less than 12 carbon atoms, so that a liquid composition is formed. The boron compound and the inorganic phosphorus acid are preferably co-present during the heating. However either such substance can be added and subjected to the heating step after the other provided that the conditions used result in the formation of a clear, liquid composition.

41 Claims, No Drawings

AUTOMATIC TRANSMISSION AND WET BRAKE FLUIDS AND ADDITIVE PACKAGE THEREFOR

This invention relates to functional fluids and additive packages, particularly automatic transmission fluids, wet brake fluids and friction-depending lubricants, and additive packages for the foregoing, all of enhanced performance capabilities, and to methods by which such enhanced performance can be realized.

Progressive improvements in the design and performance of automatic transmission and wet brake systems, and other friction-depending lubricants, requires concomitant progressive improvements in the design and performance of automatic transmission fluids, fluids for wet brake systems, and additive packages (concentrates) used in the formulation of automatic transmission fluids and wet brake fluids.

Recently, a need has arisen for an effective way of increasing the dynamic coefficient of friction of friction surfaces in contact with automatic transmission fluids. At the same time, it is desirable to increase the static coefficient of friction and to keep to a minimum the difference between the dynamic and the static coefficients of friction. These coefficient increases must be accomplished by suitable modification of the automatic transmission fluid and additive packages therefor without materially detracting from the other performance criteria applicable to automatic transmission fluids and additive packages therefor. Fulfillment of these needs is also desirable in the case of wet brake fluids and other friction-depending lubricants, and additive packages therefor.

This invention involves the discovery, inter alia, that the above needs and requirements can be satisfied by employing as a component in functional fluids (e.g., automatic transmission fluid, wet brake fluid, etc.) and in additive concentrates for producing such fluids, a small amount of one or more alcohols or polyols having less than 12 carbon atoms, preferably up to about 8 carbon atoms. Generally speaking, amounts in the range of up to about 0.5 percent by weight, e.g, about 0.01 to about 0.5 by weight, and preferably in the range of up to about 0.1 percent by weight, based on the total weight of the functional fluid are sufficient to provide the desired increases in friction coefficients. And, since the amounts of alcohol and/or* polyol are so small, their use causes little change in the overall performance criteria of the functional fluid. Thus, the alcohols and/or polyols can be employed in any conventional oil-based functional fluid formulation and in any conventional functional fluid concentrate. Preferably however, they are employed in functional fluid formulations and concentrates which contain little or no metal-containing additive—i.e., compositions which are often referred to as low-ash or ashless functional fluids. Such functional fluids contain at most about 100 ppm of metal (usually Zn and/or alkaline earth metal such as Ca), preferably no more than about 50 ppm of metal as added metal-containing components, and most preferably 30 ppm or less of such metal(s).

* For simplicity and convenience, the term "and/or" is used in this description. Whenever such term appears herein, it is used as a function word to indicate the two words or expressions are to be taken together or individually. Thus in the instance specified above, reference is made to alcohol, to polyol, and to a combination of alcohol and polyol. In other words, there are three different situations: (1) reference is made to alcohol without polyol; (2) reference is made to polyol without alcohol; (3) reference is made to alcohol with polyol.

Preferred low-ash or ashless functional fluids used in the practice of this invention preferably contain one or more phosphorus-containing components, or one or more boron-containing components, or most preferably, one or more phosphorus-and boron-containing components. The phosphorus level of the functional fluid is preferably in the range of 50 to 500 ppm. Preferably the boron level of the functional fluid is in the range of 50 to 300 ppm.

For the purposes of these preferred embodiments, it matters not what the make-up or composition of the phosphorus-and/or boron-containing component or components may have, provided that the component or components are practically soluble in the base oil at the concentration employed, and provided further that the total metal content, if any, supplied by one or more metal-containing additive components dissolved in the oil does not exceed about 100 ppm. For example, boron-containing material such as described in U.S. Pat. Nos. 3,087,936; 3,254,025; 3,281,428; 3,282,955; 3,284,410; 3,338,832; 3,344,069; 3,533,945; 3,718,663; 3,950,341; 3,991,056; 4,097,389; 4,234,435; and 4,554,086 can be present in the functional fluid. Likewise, the functional fluid can contain phosphorus-containing material such as described in U.S. Pat. Nos. 3,184,411; 3,185,645; 3,235,497; 3,265,618; 3,324,032; 3,325,567; 3,403,102; 3,502,677; 3,513,093; 3,511,780; 3,623,985; 3,865,740; 3,950,341; 3,991,056; 4,097,389; 4,234,435; 4,338,205; 4,428,849; 4,615,826; 4,648,980; and 4,747,971; and E. P. Pub. No. 384,639. Typical phosphorus-and boron-containing materials are described in U.S. Pat. Nos. 4,338,205; 4,428,849; and 4,857,214. The disclosures of each of the foregoing U.S. Patents and of the foregoing published European Patent Application are incorporated herein in toto by reference.

Although any oil-soluble phosphorus-and/or boron-containing compound or compounds can be present in the functional fluid concentrates and functional fluids improved pursuant to this invention, particularly preferred materials are the ashless dispersants which contain phosphorus and/or boron, whether in chemically-combined form or in the form of micellar structure. Such dispersants comprise Mannich reaction products and, more desirably, succinic ashless dispersants such as succinimides, succinamides, succinic esters, and succinic ester-amides, which have been produced in such a way as to reveal the presence of phosphorus and/or boron when subjected to chemical analysis. Methods for producing such materials by boronation and/or phosphorylation procedures are known and reported, for example, in many of the U. S. Patents and the European Patent publication referred to hereinabove. See especially U. S. Pat. No. 4,857,214 and E. P. Pub No. 384,639. Ashless dispersants can be boronated and phosphorylated either concurrently or sequentially in any order.

Typical functional fluid concentrates used in the practice of this invention include such materials as the following:

- HiTEC® 400 series of additives (HiTEC® 400, 401, 402, 403, 404, 405, 406, 408, 410, 412, 413, 414, 416, 420, 421, 424, 426, etc. additives; Ethyl Petroleum Additives, Inc.; Ethyl Petroleum Additives, Ltd.; Ethyl S.A.; Ethyl Canada Ltd.).
- Lubrizol LZ-6700 series of additives such as LZ-6715D (The Lubrizol Corporation).
- Paranox 445 additive (Exxon Chemical Company).
- Lubrizol LZ-7900, LZ-7901, LZ-7907, LZ-7925, LZ-7993, and LZ-7993A additives (The Lubrizol Corporation).
- Paramins ECA 9172 and 11998 additives (Exxon Chemical Company).
- Paranox 440 and 442 additives (Exxon Chemical Company).

Lubrizol LZ-6704 additive (The Lubrizol Corporation). Of the foregoing materials, the ashless or low-ash additive packages (HiTEC® 400 additive; Lubrizol LZ-6700 and LZ-6715D additives; and Paranox 445 additive) are preferred for use in the practice of this invention.

Alcohols which can be used in the practice of this invention include methyl alcohol, ethyl alcohol, propyl alcohol, isopropyl alcohol, butyl alcohol, isobutyl alcohol, sec-butyl alcohol, tert-butyl alcohol, any of the pentyl alcohols, any of the hexyl alcohols, any of the heptyl alcohols, and like alcohols containing less than 12 carbon atoms, with the alcohols having up to about 8 carbon atoms being preferred. The corresponding alkenols, cycloalkanols and cycloalkenols can be used as well as mixtures of two or more alcohols whether all acyclic or all cyclic or combinations of one or more acyclic alcohols with one or more cyclic alcohols. Cyclobutanol, cyclopentanol, methylcyclopentanol, cyclohexanol, cyclohexenol, the butenols, the pentenols, the hexenols, benzyl alcohol, 2-ethoxyethanol, 3-methoxypropanol, ethanolamine, and the like typify alcohols other than alkanols which can be used.

Polyols having less than 12 carbon atom suitable for use in the practice of this invention include glycols (diols) such as ethylene glycol, 1,2-propylene glycol, 1,3-propylene glycol, 1,2-butylene glycol, 1,4-butylene glycol, the pentanediols, the hexanediols, the heptanediols, and the like, with diols of up to about 8 carbon atoms being preferred. Also useful are such polyols as trimethylolpropane, pentaerythritol, 2-butene-1,4-diol, cyclo-hexanedimethanol, diethanolamine, triethanolamine, and the like. Particularly preferred are 1,2-alkanediols, particularly $C_3$–$C_6$ 1,2-alkanediols, and notably 1,2-propanediol (1,2-propylene glycol). A particularly preferred embodiment of the present invention involves the addition of about 0.1 percent by weight of 1,2-propylene glycol to an oil-based function fluid composition or an additive thereof.

Preferably, the compositions of this invention contain at least one oil-soluble friction modifier such as, for example, one or more alkyl phosphonates as disclosed in U.S. Pat. No. 4,356,097, aliphatic hydrocarbyl-substituted succinimides derived from ammonia or alkyl monoamines as disclosed in European Patent Publication No. 20037, dimer acid esters as disclosed in U.S. Pat. No. 4,105,571, long chain amides such as oleylamide, the combination of a long chain succinimide derivative and a long chain amide as disclosed in European Patent Publication No. 389,237, and others such as those referred to hereinafter. In the case of automatic transmission fluids, the friction modifier should be present in amount sufficient to modulate the smooth transmission of frictional torque to thereby enable the fluid to satisfy automatic transmission frictional torque design specifications such as the DEXRON®-II specification and/or the MERCON® specification, each in the form as set forth in the respective publications referred to hereinafter. In the case of tractor fluids, the frictional characteristics of fluid should be modified by the friction modifier to satisfy the present John Deere specification J-20, parts A and B, for tractor fluids.

One suitable method of determining dynamic and static coefficients of friction is by use of the High Energy, Friction, and Durability procedure of General Motors as published, for example, in the Second Edition of DEXRON®-II Automatic Transmission Fluid, Specification GM 6137-M, of July, 1978. This procedure enables determination of the kinetic torque and static torque in a friction test machine operated under a set of specified test parameters. From these torque values, it is possible to develop the corresponding coefficients of friction by use of applicable conversion factors. Another suitable method for determining these coefficients is by use of the Friction Durability Procedure of the Ford Motor Company, MERCON® Specification Number WSP-M2C185-A, as published on Feb. 2, 1987. Again, the dynamic and static torque data from the test can be converted to coefficients of friction by use of the applicable conversion factors.

To illustrate the excellent frictional characteristics achievable by the practice of this invention use was made of the above GM test procedure. The automatic transmission fluid used contained 9.8 percent by weight of HiTEC® 400 additive (Ethyl Petroleum Additives, Inc.) to which had been added 1,2-propylene glycol in amount such that the ATF contained 0.10 percent by weight of the diol. The test results are summarized in the following table.

| Test Hrs. | Total Cycles | Engagement Time, Sec. | Temp. °C. | Dynamic Torque N · m | Static Torque Minus Dynamic Torque, N · m |
|---|---|---|---|---|---|
| 0 | 10 | 0.66 | 57 | 132 | −20 |
| 1 | 180 | 0.65 | 133 | 133 | +5 |
| 24 | 4,375 | 0.65 | 141 | 137 | −8 |
| 30 | 5,400 | 0.64 | 141 | 141 | −10 |
| 50 | 9,000 | 0.64 | 141 | 141 | −7 |
| 75 | 13,500 | 0.65 | 141 | 138 | −5 |
| 90 | 16,200 | 0.64 | 141 | 140 | −4 |
| 100 | 18,000 | 0.65 | 141 | 127 | −1 |

By application of the standard of conversion function, it can be seen that the changes in dynamic coefficient of friction in the above text were as follows:

| Test Hrs. | Total Cycles | Dynamic Torque N · m | Static Torque Minus Dynamic Torque, N · m | Dynamic Co-efficient of Friction |
|---|---|---|---|---|
| 0 | 10 | 132 | −20 | 0.126 |
| 1 | 180 | 133 | +5 | 0.127 |
| 24 | 4,375 | 137 | −8 | 0.131 |
| 30 | 5,400 | 141 | −10 | 0.135 |
| 50 | 9,000 | 141 | −7 | 0.135 |
| 75 | 13,500 | 138 | −5 | 0.132 |
| 90 | 16,200 | 140 | −4 | 0.134 |
| 100 | 18,000 | 127 | −1 | 0.121 |

The following examples illustrate methods by which preblends containing ashless dispersant and an alcohol or polyol can be formed. Such preblend is suitable for use in the formulation of additive packages or additives concentrates useful in forming automatic transmission fluids, wet brake fluids, and other functional fluids used in connection with wet service friction devices.

EXAMPLE 1

To a reaction vessel equipped with heating and stirring apparatus are charged 9504 parts of HiTEC® 644 ashless dispersant (Ethyl Petroleum Additives, Inc.; Ethyl Petroleum Additives, Ltd.; Ethyl S.A.; Ethyl Canada Ltd.) and 1485 parts of Advasol 210. While stirring and applying heat to the mixture, 118.8 parts of tolutriazole (Cobratec TT-100; PMC Specialties Group, Cincinnati, Ohio) is added when the temperature reaches 100° C. When the temperature reaches 110° C., 74.25 parts of water and 118.8 parts of 1,2-propylene glycol are added to the stirred mixture. At a temperature of 115° C. a total of 297 parts of orthoboric acid is slowly added to the mixture. Thereupon the mixture is heated with stirring for 2 hours at 115° C. Then a vacuum is applied to the system for 40 minutes during which time the pressure is gradually reduced to below 50 mm Hg at 110° C. The product mixture remaining in the reaction vessel is the desired product.

EXAMPLE 2

A mixture is formed from 2600 parts of a commercial succinimide ashless dispersant (HiTEC® 644 dispersant; Ethyl Petroleum Additives, Inc.; Ethyl Petroleum Additives, Ltd.; Ethyl S.A.; Ethyl Canada Ltd.), 1000 parts of a 100 Solvent Neutral refined mineral oil diluent, 80 parts of solid phosphorous acid ($H_3PO_3$), 35 parts of tolutriazole, 80 parts of boric acid, 35 parts of 1,2-propylene glycol, and 30 parts of water. The mixture is stirred and heated at 100° C. for two hours until all of the solid materials are dissolved. While the temperature is slowly raised to 110° C., a vacuum of 40 mm Hg is gradually drawn on the product to remove volatiles including water. A clear oil-soluble solution or composition remains in the vessel which is suitable for use pursuant to this invention.

EXAMPLE 3

The procedure of Example 2 is repeated except that the amount of 1,2-propylene glycol is 100 parts.

EXAMPLE 4

The procedure of Example 2 is again repeated except that the amount of 1,2-propylene glycol is 70 parts.

EXAMPLE 5

The procedure of Example 2 is repeated except that 100 parts of 1,2-pentanediol is used instead of 100 parts of 1,2-propylene glycol.

EXAMPLE 6

The procedure of Example 2 is repeated using 100 parts of diethanolamine in lieu of the 1,2-propylene glycol.

Preblends formed such as in the above Examples can be used in the formulation of additive concentrates useful in forming functional fluid blends for use with wet service frictional devices such as wet clutches, automatic transmissions, wet brake systems, and the like.

Thus additional preferred embodiments of this invention involve the inclusion in a functional fluid, especially an automatic transmission fluid, a wet brake fluid, a manual transmission fluid, a tractor fluid, or like friction-depending lubricant, of a liquid composition formed by heating an ashless dispersant containing basic nitrogen and/or at least one hydroxy group with a boron compound, preferably boric acid, water and at least one diol of less than 12 carbon atoms (preferably a 1,2-alkylene glycol of 3 to 6 carbon atoms) such that a liquid composition is formed. Temperatures in the range of about 40 to about 200° C. and preferably in the range of about 80 to about 150° C. are normally used, and the heat is usually applied for a period in the range of about 1 to 3 hours. Water remaining after such heating should be removed by use of vacuum like stripping procedures. Substitution of an inorganic phosphorus acid, especially phosphorous acid ($H_3PO_3$) for the boric acid yields another liquid composition which in another preferred embodiment is included in such functional fluids. Particularly preferred are functional fluids of the type just described in which is included a liquid composition formed by heating under the conditions just described an ashless dispersant containing basic nitrogen and/or at least one hydroxyl group with a boron compound, preferably boric acid, water, at least one diol of less than 12 carbon atoms (preferably a 1,2-alkylene glycol of 3 to 6 carbon atoms) and an inorganic phosphorus acid, especially phosphorous acid ($H_3PO_3$) such that a liquid composition is formed. The boron compound and the inorganic phosphorus acid are preferably co-present during the heating. However either such substance can be added and subjected to the heating step after the other provided that the conditions used result in the formation of a clear, liquid composition. Any filtrable solids remaining in the liquid compositions can, of course, be filtered therefrom.

In accordance with conventional practice, various other known components can be employed in the compositions of this invention in order to partake of the properties engendered by use of such known additives. It is contemplated that any known additive can be included so long as (a) it is compatible with and soluble in the finished oleaginous liquid composition, and (b) preferably it does not contribute to the presence, if any, of more than 100 ppm of metal in the finished oleaginous liquid composition.

Described below are illustrative examples of the types of conventional additives that may be employed in the compositions of this invention.

Additives may be introduced into the compositions of this invention in order to improve the seal performance (elastomer compatibility) of the compositions. Known materials of this type include dialkyl diesters such as dioctyl sebacate, aromatic hydrocarbons of suitable viscosity such as Panasol AN-3N, products such as Lubrizol 730, polyol esters such as Emery 2935, 2936, and 2939 esters from the Emery Group of Henkel Corporation and Hatcol 2352, 2962, 2925, 2938, 2939, 2970, 3178, and 4322 polyol esters from Hatco Corporation. Generally speaking the most suitable diesters include the adipates, azelates, and sebacates of $C_8$–$C_{13}$ alkanols (or mixtures thereof), and the phthalates of $C_4$–$C_{13}$ alkanols (or mixtures thereof). Mixtures of two or more different types of diesters (e.g., dialkyl adipates and dialkyl azelates, etc.) can also be used. Examples of such materials include the n-octyl, 2-ethyl-hexyl, isodecyl, and tridecyl diesters of adipic acid, azelaic acid, and sebacic acid, and the n-butyl, isobutyl, pentyl, hexyl, heptyl, octyl, nonyl, decyl, undecyl, dodecyl, and tridecyl diesters of phthalic acid.

Antioxidants can be used, such as one or more phenolic antioxidants, aromatic amine antioxidants, sulphurized phenolic antioxidants, and organic phosphites, among others. Examples include 2,6-di-tert-butylphenol, liquid mixtures of tertiary butylated phenols, 2,6-di-tert-butyl-4-methylphenol, 4,4'-methylenebis (2,6-di-tert-butylphenol), 2,2'-methylenebis(4-methyl-6-tert-butylphenol), mixed methylene-bridged polyalkyl phenols, 4,4'-thiobis(2-methyl-6-tert-butylphenol), N,N'-di-sec-butyl-p-phenylenediamine, 4-isopropylaminodiphenyl amine, phenyl-α-naphthyl amine, and phenyl-β-naphthyl amine.

Corrosion inhibitors comprise another type of optional additive for use in this invention. Thus use can be made of dimer and trimer acids, such as are produced from tall oil fatty acids, oleic acid, linoleic acid, or the like. Products of this type are currently available from various commercial sources, such as, for example, the dimer and trimer acids sold under the HYSTRENE trademark by the Humco Chemical Division of Witco Chemical Corporation and under the EMPOL trademark by Emery Chemicals. Another useful type of corrosion inhibitor for use in the practice of this invention are the alkenyl succinic acid and alkenyl succinic anhydride corrosion inhibitors such as, for example, tetrapropenylsuccinic acid, tetrapropenylsuccinic anhydride, tetradecenylsuccinic acid, tetradecenylsuccinic anhydride, hexadecenylsuccinic acid, hexadecenylsuccinic anhydride, and the like. Also useful are the half esters of alkenyl succinic acids having 8 to 24 carbon atoms in the alkenyl group with alcohols such as the polyglycols. Other suitable corrosion inhibitors include ether amines; acid phosphates; amines; polyethoxylated compounds such as ethoxylated amines, ethoxylated phenols, and ethoxylated alcohols; imidazolines; aminosuccinic acids or derivatives thereof, and the like. Materials of these types are well known to those skilled in the art and a number of such materials are available as articles of commerce.

Foam inhibitors are likewise suitable for use as optional components in the compositions of this invention. These include silicones, polyacrylates, surfactants, and the like. Various antifoam agents are described in *Foam Control Agents* by H. T. Kerner (Noyes Data Corporation, 1976, pages 125–176), the disclosure of which is incorporated herein by reference. Mixtures of silicone-type antifoam agents such as the liquid dialkyl silicone polymers with various other substances are also effective. Typical of such mixtures are silicones mixed with an acrylate polymer, silicones mixed with one or more amines, and silicones mixed with one or more amine carboxylates.

Copper corrosion inhibitors constitute another class of additives suitable for inclusion in the compositions of this invention. Such compounds include thiazoles, triazoles and thiadiazoles. Examples of such compounds include benzotriazole, tolyltriazole, octyltriazole, decyltriazole, dodecyltriazole, 2-mercapto-benzothiazole, 2,5-dimercapto-1,3,4-thiadiazole, 2-mercapto-5-hydrocarbylthio -1,3,4-thiadiazoles, 2-mercapto-5-hydrocarbyldithio- 1,3,4-thiadiazoles, 2,5-bis(hydrocarbylthio)-1,3,4-thiadiazoles, and 2,5-(bis)hydrocarbyldithio)-1,3,4-thiadiazoles. The preferred compounds are the 1,3,4-thiadiazoles, a number of which are available as articles of commerce. Such compounds are generally synthesized from hydrazine and carbon disulfide by known procedures. See for example to U. S. Pat. Nos. 2,765,289; 2,749,311; 2,760,933; 2,850,453; 2,910,439; 3,663,561; 3,862,798; and 3,840,549.

The compositions of this invention may also contain friction modifiers such as aliphatic amines or ethoxylated aliphatic amines, aliphatic fatty acid amides, aliphatic carboxylic acids, aliphatic carboxylic esters, aliphatic carboxylic esteramides, aliphatic phosphonates, aliphatic phosphates, aliphatic thiophosphonates, aliphatic thiophosphates, etc., wherein the aliphatic group usually contains above about eight carbon atoms so as to render the compound suitably oil soluble. Also suitable are aliphatic substituted succinimides formed by reacting one or more aliphatic succinic acids or anhydrides with ammonia.

Metal-containing detergents such as calcium phenates, magnesium phenates, calcium sulfonates, magnesium sulfonates, etc. can also be used. However, as noted above, if an oil-soluble phenate or sulfonate is used, preferably it is proportioned such that the finished fluid contains no more than about 100 ppm of metal.

Still other components useful in the compositions of this invention are lubricity agents such as sulfurized fats, sulfurized isobutylene, dialkyl polysulfides, and sulfur-bridged phenols such as nonylphenol polysulfide. Air release agents, pour point depressants, viscosity index improvers, dyes, and the like can also be included in the compositions of this invention.

In selecting any of the foregoing optional additives, it is of course important to ensure that the selected component(s) are soluble in the oleaginous liquid, are compatible with the other components of the composition, and do not interfere significantly with the friction properties desired in the overall finished oleaginous composition.

The additive combinations of this invention can be incorporated in a wide variety of base oils in effective amounts to provide suitable active ingredient concentrations. The base oils not only can be hydrocarbon oils of lubricating viscosity derived from petroleum (or tar sands, coal, shale, etc.), but also can be natural oils of suitable viscosities such as rapeseed oil, etc., and synthetic oils such as hydrogenated polyolefin oils; poly-α-olefins (e.g., hydrogenated or unhydrogenated α-olefin oligomers such as hydrogenated poly-1-decene); alkyl esters of dicarboxylic acids; complex esters of dicarboxylic acid, polyglycol and alcohol; alkyl esters of carbonic or phosphoric acids; polysilicones; fluorohydrocarbon oils; and mixtures of mineral, natural and/or synthetic oils in any proportion, etc. The term "base oil" for this disclosure includes all the foregoing.

The additive combinations of this invention can thus be used in compositions, in which the base oil of lubricating viscosity is a mineral oil, a synthetic oil, a natural oil such as a vegetable oil, or a mixture thereof, e.g. a mixture of a mineral oil and a synthetic oil.

Suitable mineral oils include those of appropriate viscosity refined from crude oil of any source including Gulf Coast, Mid-continent, Pennsylvania, California, Alaska, Middle East, North Sea and the like. Standard refinery operations may be used in processing the mineral oil. Among the general types of petroleum oils useful in the compositions of this invention are solvent neutrals, bright stocks, cylinder stocks, residual oils, hydrocracked base stocks, paraffin oils including pale oils, and solvent extracted naphthenic oils. Such oils and blends of them are produced by a number of conventional techniques which are widely known by those skilled in the art.

As is noted above, the base oil can consist essentially of or comprise a portion of one or more synthetic oils. Among the suitable synthetic oils are homo-and inter-polymers of $C_2$–$C_{12}$ olefins, carboxylic acid esters of both monoalcohols and polyols, polyethers, silicones, polyglycols, silicates, alkylated aromatics, carbonates, thiocarbonates, orthoformates, phosphates and phosphites, borates and halogenated hydrocarbons. Representative of such oils are homo-and interpolymers of $C_2$–$C_{12}$ monoolefinic hydrocarbons, alkylated benzenes (e.g., dodecyl benzenes, didodecyl benzenes, tetradecyl benzenes, dinonyl benzenes, di-(2-ethylhexyl)benzenes, wax-alkylated naphthalenes); and polyphenyls (e.g., biphenyls, terphenyls).

Alkylene oxide polymers and interpolymers and derivatives thereof where the terminal hydroxyl groups have been modified by esterification, etherification, etc., constitute another class of synthetic oils. These are exemplified by the oils prepared through polymerization of alkylene oxides such as ethylene oxide or propylene oxide, and the alkyl and aryl ethers of these polyoxyalkylene polymers (e.g., methyl polyisopropylene glycol ether having an average molecular weight of 1000, diphenyl ether of polyethylene glycol having a molecular weight of 500–1000, diethyl ether of polypropylene glycol having a molecular weight of 1000–1500) or mono-and poly-carboxylic esters thereof, for example, the acetic acid ester, mixed $C_3$–$C_6$ fatty acid esters, or the $C_{13}$ Oxo acid diester of tetraethylene glycol.

Another suitable class of synthetic oils comprises the esters of dicarboxylic acids (e.g., phthalic acid, succinic acid, maleic acid, azelaic acid, suberic acid, sebacic acid, fumaric acid, adipic acid, linoleic acid dimer) with a variety of alcohols (e.g., butyl alcohol, hexyl alcohol, dodecyl alcohol, 2-ethylhexyl alcohol, ethylene glycol). Specific examples of these esters include dibutyl adipate, di(2-ethylhexyl)adipate, didodecyl adipate, di(2-ethylhexyl) sebacate, dilauryl sebacate, di-n-hexyl fumarate, dioctyl sebacate, diisooctyl azelate, diisodecyl azelate, dioctyl phthalate, didecyl phthalate, di(eicosyl)sebacate, the 2-ethylhexyl diester of linoleic acid dimer, and the complex ester formed by reacting one mole of sebacic acid with two moles of tetraethylene glycol and two moles of 2-ethylhexanoic acid.

Esters which may be used as synthetic oils also include those made from $C_3$–$C_{12}$ monocarboxylic acids and polyols and polyol ethers such as neopentyl glycol, trimethylolpropane, pentaerythritol and dipentaerythritol. Trimethylol propane tripelargonate and pentaerythritol tetracaproate serve as examples.

Silicon-based oils such as the polyalkyl-, polyaryl-, polyalkoxy-, or polyaryloxy-siloxane oils and silicate oils comprise another class of synthetic lubricants (e.g., tetraethyl silicate, tetraisopropyl silicate, tetra-(2-ethylhexyl) silicate, tetra-(p-tert-butylphenyl) silicate, poly(methyl) siloxanes, and poly(methylphenyl)siloxanes. Other synthetic lubricating oils include liquid esters of phosphorus-containing acids (e.g., tricresyl phosphate, trioctyl phosphate, triphenyl phosphite, and diethyl ester of decane phosphonic acid.

Also useful as base oils or as components of base oils are hydrogenated or unhydrogenated liquid oligomers of $C_6$–$C_{16}$ alpha-olefins, such as hydrogenated or unhydrogenated oligomers formed from 1-decene. Methods for the production of such liquid oligomeric 1-alkene hydrocarbons are known and reported in the literature. See for example U. S. Pat. Nos. 3,749,560; 3,763,244; 3,780,128; 4,172,855; 4,218,330; and 4,950,822, the disclosures of which are incorporated herein by reference. Additionally, hydrogenated 1-alkene oligomers of this type are available as articles of commerce, for example, under the trade designations ETHYLFLO® 162, ETHYLFLO® 164, ETHYLFLO® 166, ETHYLFLO® 168, ETHYLFLO® 170, ETHYLFLO® 174, and ETHYLFLO® 180 poly-a-olefin oils (Ethyl Corporation; Ethyl S. A.; Ethyl Canada Ltd.). Blends of such materials can also be used in order to adjust the viscometrics of the given base oil. Suitable 1-alkene oligomers are also available from other suppliers. As is well known, hydrogenated oligomers of this type contain little, if any, residual ethylenic unsaturation.

Preferred oligomers are formed by use of a Friedel-Crafts catalyst (especially boron trifluoride promoted with water or a $C_{1-20}$ alkanol) followed by catalytic hydrogenation of the oligomer so formed using procedures such as are described in the foregoing U.S. patents.

Other catalyst systems which can be used to form oligomers of 1-alkene hydrocarbons, which, on hydrogenation, provide suitable oleaginous liquids include Ziegler catalysts such as ethyl aluminum sesquichloride with titanium tetrachloride, aluminum alkyl catalysts, chromium oxide catalysts on silica or alumina supports and a system in which a boron trifluoride catalyst oligomerization is followed by treatment with an organic peroxide.

It is also possible in accordance with this invention to utilize blends of one or more liquid hydrogenated 1-alkene oligomers in combination with other oleaginous materials having suitable viscosities, provided that the resultant blend has suitable compatibility and possesses the physical properties desired.

Typical natural oils that may be used as base oils or as components of the base oils include castor oil, olive oil, peanut oil, rapeseed oil, corn oil, sesame oil, cottonseed oil, soybean oil, sunflower oil, safflower oil, hemp oil, linseed oil, tung oil, oiticica oil, jojoba oil, and the like. Such oils may be partially or fully hydrogenated, if desired.

The fact that the base oils used in the compositions of this invention may be composed of (i) one or more mineral oils, (ii) one or more synthetic oils, (iii) one or more natural oils, or (iv) a blend of (i) and (ii), or (i) and (iii), or (ii) and (iii), or (i), (ii) and (iii) does not mean that these various types of oils are necessarily equivalents of each other. Certain types of base oils may be used in certain compositions for the specific properties they possess such as high temperature stability, nonflammability or lack of corrosivity towards specific metals (e.g. silver or cadmium). In other compositions, other types of base oils may be preferred for reasons of availability or low cost. Thus, the skilled artisan will recognize that while the various types of base oils discussed above may be used in the compositions of this invention, they are not necessarily functional equivalents of each other in every instance.

In general, the components of the additive compositions of this invention are employed in the oleaginous liquids in minor amounts sufficient to improve the performance characteristics and properties of the base fluid. The amounts will thus vary in accordance with such factors as the viscosity characteristics of the base fluid employed, the viscosity characteristics desired in the finished fluid, the service conditions for which the finished fluid is intended, and the performance characteristics desired in the finished fluid. However, generally speaking, the following concentrations (weight percent) of the components (active ingredients) in the base fluids are illustrative:

| | Typical Range | Preferred Range |
|---|---|---|
| Seal performance improver | 0–30 | 1–20 |
| Antioxidant | 0–1 | 0.1–1 |
| Corrosion inhibitor | 0–0.5 | 0.005–0.1 |
| Foam inhibitor | 0–0.01 | 0.0001–0.005 |
| Copper corrosion inhibitor | 0–0.5 | 0.01–0.1 |
| Friction modifier | 0–1 | 0.05–0.5 |
| Lubricity agent | 0–1.5 | 0.5–1 |
| Viscosity index improver | 0–10 | 0–9 |
| Dye | 0–0.05 | 0.015–0.035 |

It will be appreciated that the individual components employed can be separately blended into the base fluid or can be blended therein in various subcombinations, if desired. Ordinarily, the particular sequence of such blending steps is not critical. Moreover, such components can be blended in the form of separate solutions in a diluent. It is preferable, however, to blend the components used in the form of an additive concentrate of this invention, as this simplifies the blending operations, reduces the likelihood of blending errors, and takes advantage of the compatibility and solubility characteristics afforded by the overall concentrate.

The additive concentrates of this invention will contain the selected components in amounts proportioned to yield finished fluid blends consistent with the concentrations tabulated above. In most cases, the additive concentrate will contain one or more diluents such as light mineral oils, to facilitate handling and blending of the concentrate. Thus concentrates containing up to 50% by weight of one or more diluents or solvents can be used.

The oleaginous liquids provided by this invention can be used in a variety of applications. For example, they can be employed as crankcase lubricants, hydraulic fluids, manual transmission fluids, cutting and machining fluids, brake fluids, shock absorber fluids, heat transfer fluids, quenching oils, transformer oils, and the like. The compositions are particularly suitable for use as automatic transmission fluids and wet brake fluids and other friction-depending lubricants.

It will be readily apparent that this invention is susceptible to considerable modification in its practice. Accordingly, this invention is not intended to be limited by the specific exemplifications presented hereinabove. Rather, what is intended to be covered is within the spirit and scope of the appended claims.

What is claimed is:

1. In an oil-based functional fluid composition formulated for use as an automatic transmission fluid or a fluid for a wet brake system, the improvement pursuant to which said composition contains a minor amount in the range of up to about 0.5 percent by weight based on the total weight of the functional fluid composition of at least one polyol selected from the group consisting of ethylene glycol, 1,3-propylene glycol, 1,4-butylene glycol, trimethylolpropane, pentaerythritol, 2-butene-1, 4-diol, cyclohexanedimethanol, and 1,2-alkanediols having from 3 to 6 carbon atoms in the molecule to increase the dynamic and/or static coefficients of friction of the frictional surfaces of the automatic transmission or wet brake system contacted by the composition.

2. The improvement according to claim 1 wherein said at least one polyol is a 1,2-alkanediol having from 3 to 6 carbon atoms.

3. The improvement according to claim 1 wherein said amount is up to about 0.1 percent based on the total weight of the functional fluid composition.

4. The improvement according to claim 1 wherein said at least one polyol is 1,2-propylene glycol.

5. The improvement according to claim 1 wherein all or part of the diol is 1,2-propylene glycol present in an amount of about 0.1 percent by weight based on the total weight of said composition.

6. The improvement according to claim 1 wherein said amount is in the range of about 0.01 to about 0.5 percent by weight based on the total weight of said composition.

7. The improvement according to claim 1 wherein said at least one polyol is a 1,2-alkanediol having 3 to 6 carbon atoms, and wherein said amount is in the range of about 0.01 to about 0.5 percent by weight based on the total weight of said composition.

8. The improvement according to claim 1 wherein said amount is sufficient to increase the said dynamic coefficient of friction by about 0.005 to about 0.025 as compared to the same composition not containing said polyol.

9. In an oil-based functional fluid composition formulated for use as an automatic transmission fluid, the improvement pursuant to which said composition contains a minor amount of at least the following components: a) one or more oil soluble phosphorus-containing additives and/or Phosphorus-and boron-containing additives in an amount sufficient to provide in said fluid composition a phosphorus content in the range of 50 to 500 ppm and b) one or more polyols selected from the group consisting of ethylene glycol, 1.3-propylene glycol, 1,4-butylene glycol, trimethylolpropane, pentaerythritol, 2-butene-1.4-diol, cyclohexanedimethanol, and 1,2-alkanediols having from 3 to 6 carbon atoms in the molecule; said composition providing a dynamic coefficient of friction within the range of about 0.12 to about 0.17.

10. The improvement according to claim 9 wherein said one or more polyols of b) are 1.2-alkanediols having 3 to 6 carbon atoms.

11. The improvement according to claim 9 wherein said one or more additives of a) are phosphorylated ashless dispersants.

12. The improvement according to claim 9 wherein said one or more additives of a) are boronated and phosphorylated ashless dispersants, and wherein the boronation and phosphorylation are conducted concurrently or sequentially in any order.

13. The improvement according to claim 12 wherein the boronation and phosphorylation are conducted concurrently.

14. The improvement according to claim 9 wherein said functional fluid composition is an ashless or low-ash functional fluid composition.

15. The improvement according to claim 13 wherein said functional fluid composition is an ashless or low-ash functional fluid composition.

16. The improvement according to claim 9 wherein said functional fluid comprises a phosphorus level in the range of 50 to 500 ppm and a boron level in the range of 50 to 300 ppm.

17. In an additive concentrate formulated for use in the production of an oil-based automatic transmission fluid, said concentrate comprising one or more diluents or solvents in an amount that does not exceed 50 percent by weight with the balance being additive components, the improvement pursuant to which said concentrate contains a minor amount of one or more polyols selected from the group consisting of ethyleneglycol, 1,3-propyleneglycol, 1,4-butyleneglycol, trimethylolpropane, pentaerythritol, 2-butene-1,4-diol, cyclohexanedimethanol, and 1,2-alkanediols having from 3 to 6 carbon atoms in the molecule, said polyol having the ability of increasing the dynamic and static coefficient of friction of a friction surface within an automatic transmission in contact with at least mineral oil-based transmission fluid containing said concentrate at a concentration such that said fluid contains an amount of said polyol in the range of 0.01 to 0.5 weight percent based on the total weight of the automatic transmission fluid.

18. The improvement of claim 16 wherein said one or more polyols is a 1,2-alkanediol having 3 to 6 carbon atoms.

19. The improvement of claim 17 wherein said one or more polyols is 1.2-propylene glycol.

20. The improvement of claim 17 wherein said additive concentrate further comprises one or more oil-soluble phosphorus-and/or boron-containing additives, and wherein said additive concentrate when blended with a metal-free base oil in an automatic transmission fluid to a concentration in the range of 5 to 50 weight percent, provides an automatic transmission fluid containing, no more than about 100 ppm of metal in the form of one or more additive components.

21. The improvement of claim 20 wherein said at least one polyol is a 1,2-alkanediol having 3 to 6 carbon atoms.

22. The improvement of claim 20 wherein said at least one polyol is 1,2-propylene glycol.

23. A method of increasing the dynamic coefficient of friction between frictional surfaces contacted by a functional fluid suitable for use as an automatic transmission fluid, a fluid for a wet brake system, or a friction-depending lubricant, which method comprises blending with said functional fluid one or more polyols selected from the group consisting of ethylene glycol, 1,3-propylene glycol, 1,4-butylene glycol, trimethylolpropane, pentaerythritol, 2-butene-1,4-diol, cyclohexane-dimethanol, and 1,2-alkanediols having from 3 to 6 carbon atoms in the molecule in an amount that does not exceed about 0.5 percent by weight based on the total weight of the fluid, said amount being sufficient to increase said dynamic coefficient of friction.

24. The method of claim 23 wherein said one or more polyols is at least one 1.2-alkanediol having 3 to 6 carbon atoms.

25. The method of claim 24 wherein said 1,2-alkanediol is 1,2-propylene glycol.

26. The method of claim 23 wherein the said dynamic coefficient of friction is increased by about 0.005 to about 0.025 as compared to the dynamic coefficient of friction existing between the same frictional surfaces contacted by the same functional fluid not containing said one or more polyols.

27. In a low-ash or ashless oil-based functional fluid composition formulated for use as an automatic transmission fluid or a fluid for a wet brake system, the improvement pursuant to which said composition contains a minor amount in the rang of up to about 0 .5 percent by weight based on the total weight of the functional fluid composition of at least one polyol selected from the group consisting of ethylene glycol, 1,3-propylene glycol, 1,4-butylene glycol, trimethylolpropane, pentaerythritol, 2-butene-1,4-diol, cyclohexanedimethanol, and 1,2-alkanediols having from 3 to 6 carbon atoms in the molecule to increase the dynamic and/or static coefficients of friction of the friction surfaces of the automatic transmission or wet brake system contacted by the composition.

28. The improvement according to claim 27 wherein said functional fluid composition comprises less than about 100 ppm of metal.

29. The improvement according to claim 27 wherein said at least one polyol is a 1,2-alkanediol having from 3 to 6 carbon atoms.

30. The improvement according to claim 27 wherein said amount is up to about 0.1 percent based on the total weight of the functional fluid composition.

31. The improvement according to claim 27 wherein said at least one polyol is 1,2-propylene glycol.

32. In a low-ash or ashless oil-based functional fluid composition formulated for use as an automatic transmission fluid, the improvement pursuant to which said composition contains a minor amount of at least the following components: a) one or more oil soluble phosphorus-containing additives and/or phosphorus-and boron-containing additives in an amount sufficient to provide in said fluid composition a phosphorus content in the range of 50 to 500 ppm and b) one or more polyols selected from the group consisting of ethylene glycol, 1,3-propylene glycol, 1,4-butylene glycol, trimethylolpropane, pentaerythritol, 2-butene-1,4-diol, cyclohexanedimethanol, and 1,2-alkanediols having from 3 to 6 carbon atoms in the molecule; said composition providing a dynamic coefficient of friction within the range of about 0.12 to about 0.17.

33. The improvement according to claim 32 wherein said one or more polyols of b) are 1,2-alkanediols having 3 to 6 carbon atoms.

34. The improvement according to claim 32 wherein said functional fluid comprises a phosphorus level in the range of 50 to 500 ppm and a boron level in the range of 50 to 300 ppm.

35. The improvement according to claim 32 wherein said functional fluid composition comprises less that about 100 ppm of metal.

36. In an additive concentrate formulated for use in the production of a low-ash or ashless oil-based automatic transmission fluid, said concentrate comprising one or more diluents or solvents in an amount that does not exceed 50 percent by weight with the balance being additive components, the improvement pursuant to which said concentrate contains a minor amount of one or more polyols selected from the group consisting of ethylene glycol, 1,3-propylene glycol, 1,4-butylene glycol, trimethylolpropane, pentaerythritol, 2-butene-1,4-diol, cyclohexanedimethanol, and 1,2-alkanediols having from 3 to 6 carbon atoms in the molecule, said polyol having the ability of increasing the dynamic and static coefficient of friction of a friction surface within an automatic transmission in contact with at least mineral oil-based transmission fluid containing said concentrate at a concentration such that said fluid contains an amount of said polyol in the range of 0.01 to 0.5 weight percent based on the total weight of the automatic transmission fluid.

37. The improvement of claim 36 wherein said one or more polyols is a 1,2-alkanediol having 3 to 6 carbon atoms.

38. The method of claim 37 wherein said one or more polyols is at least one 1,2-alkanediol having 3 to 6 carbon atoms.

39. The improvement of claim 37 wherein said at least one polyol is 1,2-propylene glycol.

40. The improvement of claim 36 wherein said one or more polyols is 1,2-propylene glycol.

41. A method of increasing the dynamic coefficient of friction between frictional surfaces contacted by a low-ash or ashless functional fluid suitable for use as an automatic transmission fluid, a fluid for a wet brake system, or a friction-depending lubricant, which method comprises blending with said functional fluid one or more polyols selected from the group consisting of ethylene glycol, 1,3-propylene glycol, 1,4-butylene glycol, trimethylolpropane, pentaerythritol, 2-butene-1,4-diol, cyclohexanedimethanol, and 1,2-alkanediols having from 3 to 6 carbon atoms in the molecule in an amount that does not exceed about 0.5 percent by weight based on the total weight of the fluid, said amount being sufficient to increase said dynamic coefficient of friction.

* * * * *